US010611542B2

(12) United States Patent
Carling

(10) Patent No.: US 10,611,542 B2
(45) Date of Patent: Apr. 7, 2020

(54) QUICK CONNECTION DEVICES FOR ASEPTIC BAGS

(71) Applicants: Goglio S.p.A., Milan (MI) (IT); Goglio (Tianjin) Packaging Co., Ltd., Tianjin (CN)

(72) Inventor: Grant Carling, Tianjin (CN)

(73) Assignee: GOGLIO (TIANJIN) PACKAGING CO., LTD., Tianjin (CN)

( * ) Notice: Subject to any disclaimer, the term of this patent is extended or adjusted under 35 U.S.C. 154(b) by 0 days.

(21) Appl. No.: 16/084,294

(22) PCT Filed: Dec. 15, 2016

(86) PCT No.: PCT/EP2016/081217
§ 371 (c)(1),
(2) Date: Sep. 12, 2018

(87) PCT Pub. No.: WO2017/157494
PCT Pub. Date: Sep. 21, 2017

(65) Prior Publication Data

US 2019/0071233 A1 Mar. 7, 2019

(30) Foreign Application Priority Data

Mar. 14, 2016 (CN) ..... 2016 2 0194302 U

(51) Int. Cl.
*B65D 75/58* (2006.01)
*B65D 77/06* (2006.01)
*B65D 51/20* (2006.01)

(52) U.S. Cl.
CPC ..... *B65D 75/5877* (2013.01); *B65D 77/068* (2013.01); *B65D 51/20* (2013.01)

(58) Field of Classification Search
CPC ... B65D 75/5877; B65D 77/068; B65D 51/20
See application file for complete search history.

(56) References Cited

U.S. PATENT DOCUMENTS 4,257,535 A 3/1981 Mellett
5,095,962 A * 3/1992 Lloyd-Davies ..... B67D 3/045 141/114

(Continued)

FOREIGN PATENT DOCUMENTS

EP 0 007 685 A1 2/1980
WO 1985/003062 A1 7/1985

(Continued)

OTHER PUBLICATIONS

International Search Report and Written Opinion dated Mar. 29, 2017, in PCT Application No. PCT/EP2016/081217, 12 pages.

*Primary Examiner* — Frederick C Nicolas
(74) *Attorney, Agent, or Firm* — MH2 Technology Law Group LLP

(57) ABSTRACT

A quick connection device for an aseptic bag may include: a mouth; a mouth sealing cover; and a mouth connection piece. To prevent flow through the mouth, the mouth sealing cover is mountable at the mouth. To allow the flow through the mouth, the mouth connection piece is mountable at the mouth. The mouth can include arc-shaped grooves on an upper surface of the mouth. When the mouth sealing cover is mounted at the mouth, a lower surface of the mouth can be sealed with laminate compound film. The mouth sealing cover can include arc-shaped heaves on two sides. When the mouth sealing cover is mounted at the mouth, the arc-shaped heaves can be fastened with the arc-shaped grooves on the upper surface of the mouth for sealing.

20 Claims, 3 Drawing Sheets

(56) References Cited

U.S. PATENT DOCUMENTS

| | | | | |
|---|---|---|---|---|
| 6,595,391 | B1 * | 7/2003 | Anderson | B65B 55/022 222/105 |
| 6,612,545 | B1 * | 9/2003 | Rutter | B65D 77/067 141/346 |
| 7,357,277 | B2 * | 4/2008 | Verespej | B65D 47/0814 222/153.01 |
| 7,546,857 | B2 * | 6/2009 | Chadbourne | B67D 1/0835 137/614.04 |
| 8,511,639 | B2 * | 8/2013 | Johnson | B67D 1/0829 141/346 |
| 10,227,167 | B2 * | 3/2019 | Darby | B65D 77/067 |
| 2004/0232175 | A1 | 11/2004 | Decler et al. | |
| 2014/0319094 | A1 | 10/2014 | Thurman et al. | |

FOREIGN PATENT DOCUMENTS

| | | | |
|---|---|---|---|
| WO | 2001/079739 | A2 | 10/2001 |
| WO | 2004/103834 | A1 | 12/2004 |
| WO | 2014/172588 | A2 | 10/2014 |

* cited by examiner

QUICK CONNECTION DEVICES FOR ASEPTIC BAGS

CROSS-REFERENCE TO RELATED APPLICATION(S)

This application is a national stage entry from International Application No. PCT/EP2016/081217, filed on Dec. 15, 2016, in the Receiving Office ("RO/EP") of the European Patent Office ("EPO"), and published as International Publication No. WO 2017/157494 A1 on Sep. 21, 2017; International Application No. PCT/EP2016/081217 claims priority from Chinese Patent Application No. 201620194302.1, filed on Mar. 14, 2016, in the State Intellectual Property Office ("SIPO") of the People's Republic of China, the entire contents of all of which are incorporated herein by reference.

TECHNICAL FIELD

The present invention relates generally to food packaging in light industry and specifically to aseptic packaging bag of liquid products, according to preamble of Claim 1.

BACKGROUND

Existing standard aseptic bags have fully sealed gland type mouths.

Such mouth has the widest application, and is applicable for general aseptic bag filling machines. As such, mouth has a one-time press-in structure, and is pressed into the seat of the aseptic bag by means of shrink fit after filling, it cannot be pulled out after press-in. Thus, when the material in the bag needs to be exported, destructive process such as opening the bag by cutting has to be used.

Such mouth does not support liquid discharge, cannot be connected with automatic liquid discharge equipment such as bag-in-box (a kind of small volume aseptic bag) field preparation machine, and cannot realize quantified automatic liquid discharge. Such shortcoming causes great restriction to application of bag-in-box on field preparation machine.

The technical problem to be solved is to overcome the shortcoming of existing technology and provide a kind of aseptic bag quick connection device that can be both used for general aseptic bag filling machine and connected with field preparation machine for liquid discharge.

The above-mentioned problem is solved by an aseptic bag quick connection device according to claim 1.

The aseptic bag mouth is fixed with the mouth sealing cover through spot welding.

The outline dimension of the aseptic bag mouth is consistent with that of existing standard aseptic bags, and holes are set in the middle of the mouth for liquid discharge.

The aseptic bag mouth has arc-shaped grooves on the upper surface, and the lower surface of the mouth is sealed with laminate compound film.

The arc-shaped heaves of the mouth sealing cover have the same shape as the arc-shaped grooves on the upper surface of the bag mouth, used for sealing.

The outer dimension of the inner rings of the heaves on the lower surface is consistent with the inner dimension of the holes in the mouth.

The dimension of the outer rings of the heaves on the lower surface is consistent with the dimension of the grooves in the mouth.

By virtue of the matching of these two parts, the bag mouth can be fastened tightly with the sealing cover. Meanwhile, the sealing cover is fixed with the bag mouth through spot welding.

After an aseptic bag is filled on a filling machine, the filling machine can press the bag mouth covered with the sealing cover into the seat of the aseptic bag to form close connection. Meanwhile, as the bottom of the bag mouth is sealed with laminate compound film, which can isolate the liquid in the bag from the atmosphere, the aseptic condition inside the bag after filling can be ensured.

As the outline dimension of the aseptic bag mouth in this invention is completely consistent with that of existing standard aseptic bags, aseptic bags with the mouths described in this utility model can be used freely for the existing standard aseptic bag filling machines.

The mouth connection piece is used to connect the aseptic bag mouth with the liquid tube of the field preparation machine at the time of liquid discharge, so that the liquid in the aseptic bag can be exported automatically through the field preparation machine without damage of the bag.

The lower part of the connection piece is for connection with the bag mouth, and the oblique edge (or tip) at the bottom of the connection piece is used to pierce the laminate compound film at the bottom of the bag mouth.

There are four discharge holes at the lower position of the connection piece, which are evenly distributed in a circle and are used for liquid discharge after connection with the bag mouth.

There are two sealing rings at the middle section of the connection piece, which can ensure complete sealing of the bag mouth.

The upper and middle part of the connection piece has a rotating arm, there is a slot in each end of the rotating arm, and the dimension of the slot is consistent with the dimension of the outer edge of the bag mouth adjacent to the arc-shaped groove.

When the connection piece is correctly connected to the bag mouth, the connection piece can be rotated by certain angle through the rotating arm, while the contact between the slot and the outer edge of bag mouth can realize fixing of the connection piece on the bag mouth.

The upper part of the connection piece is used for connection with liquid tube of the field preparation machine, where firmness of the liquid tube after inserting can be secured by the ratchets of the connection piece.

This disclosure is designed to ensure convenient and sanitary discharge and use of liquid products packaged in aseptic bags, and to realize quick and clean connection between aseptic bags and discharging equipment.

Compared with existing technologies, the beneficial effects of this invention are as follows:

1. The bag mouth in this invention is disposable, so that sanitation of product filling can be ensured;

2. This disclosure helps to realize automatic liquid discharge of aseptic bags connected with field preparation machine, which cannot be achieved using existing technology. With this invention, the application field of aseptic bags can be broadened;

3. As automatic liquid discharge can be realized, users do not need to cut the aseptic bags to use the liquid inside, so that the using process is more convenient and sanitary;

4. Under existing technical conditions, sometimes it is necessary to arrange a second discharge mouth to discharge the liquid without damaging the bag. In the case of this invention, the functions of filling and discharge is integrated into a whole, and additional discharge mouth is unnecessary, leading to reduced cost;

5. The dimension of the bag mouth in this invention is consistent with that in existing technology, and bags with such mouths can be used for all filling machines compatible with existing bag mouths;

6. Users may choose to use the mouth connection piece on one-time basis or on repeated basis, providing more options for users in terms of cost reduction.

This disclosure is usable in packaging of dairy, beverage and liquid food, and also in other fields involving flowing products.

DETAILED DESCRIPTION

This disclosure is further described below in combination with the drawings and the embodiments.

It should be understood that the embodiments described here are only for the purpose of explaining this disclosure but do not restrict this disclosure.

An aseptic bag quick connection device 100 (FIG. 6) consists of three parts, respectively an aseptic bag mouth 1, a mouth sealing cover 2 and mouth connection piece 3.

Figure 1:
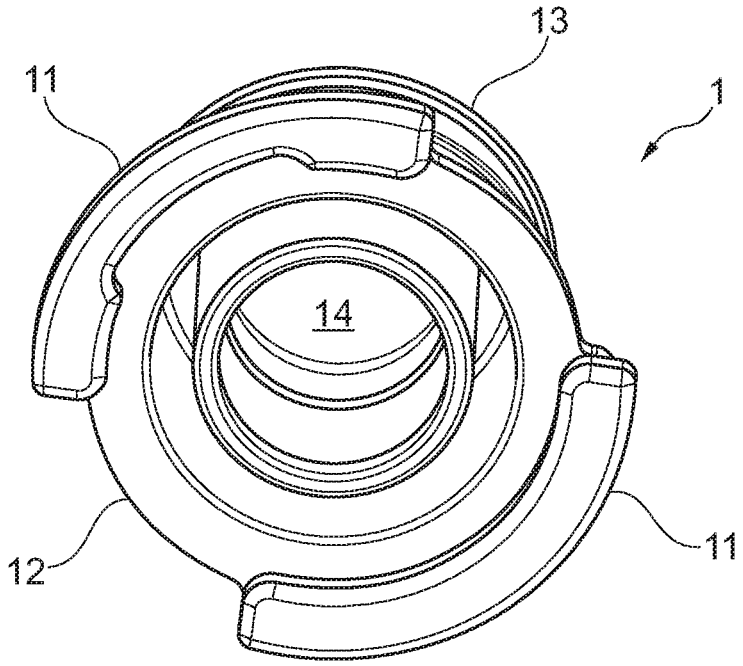
FIG. 1 is a structure sketch of the aseptic bag mouth according to the present disclosure.

As shown in FIG. 1, the aseptic bag mouth 1 has arc-shaped grooves 11 on the upper surface 12, and the lower surface 13 of the mouth 1 is sealed with laminate compound film 14.

Figure 2:
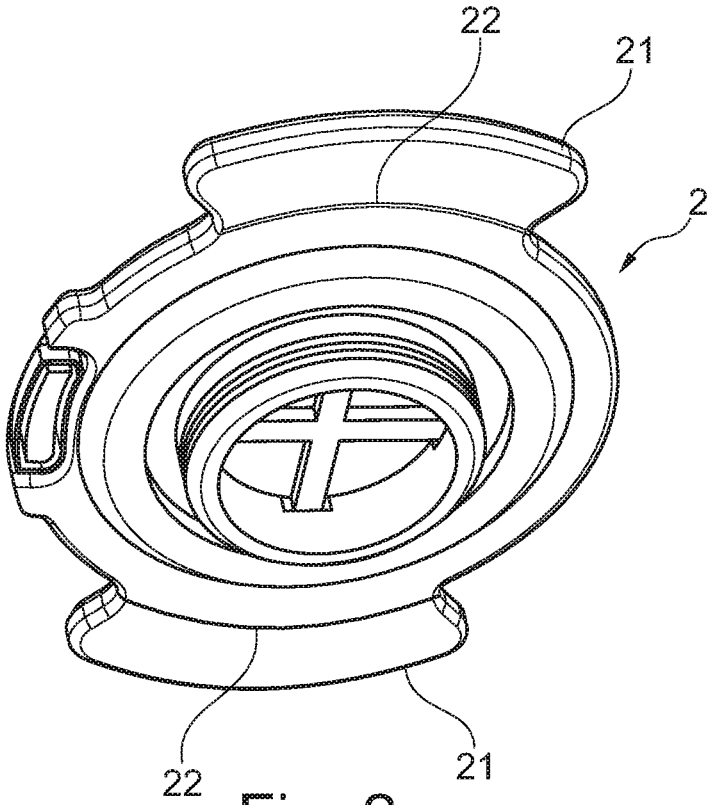
FIG. 2 is a structure sketch of the mouth sealing cover in this patent specification.

As shown in FIG. 2, the mouth sealing cover 2 has arc-shaped heaves 21 on the two sides 22, and the arc-shaped heaves 21 are fastened with the arc-shaped grooves 11 on the upper surface 12 of the bag mouth 1 for sealing.

Figure 3:
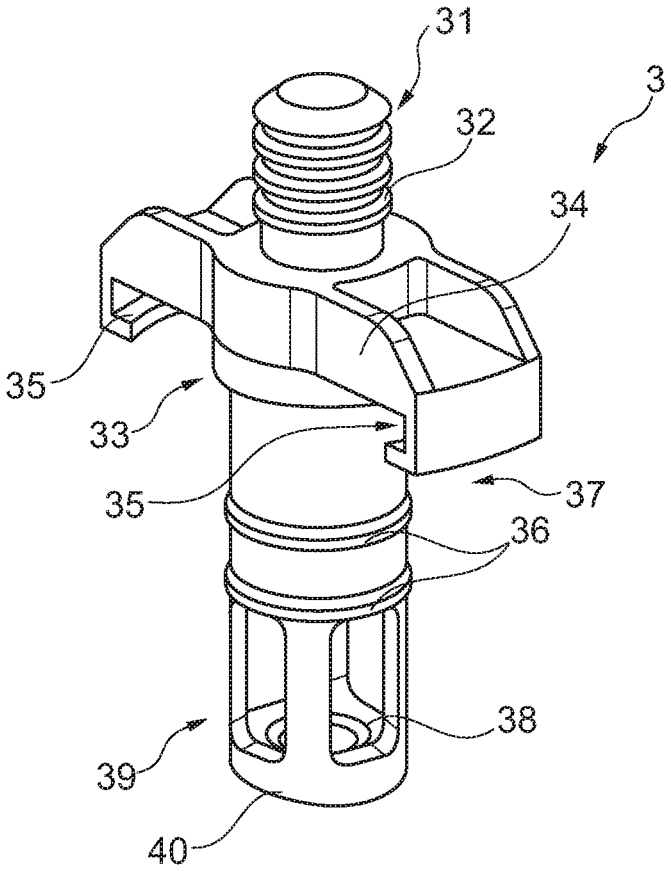
FIG. 3 is a structure sketch of the mouth connection piece according to the present disclosure.

As shown in FIG. 3, the mouth connection piece 3 is a hollow tube piece, the upper part 31 of the connection piece is a connection 32 for connection with silica gel tube, the upper part 31 and middle part 33 of the mouth connection piece 3 have a rotating arm 34.

There is a slot 35 in each end of the rotating arm 34, the dimension of the slot is consistent with the dimension of the outer edge of the bag mouth 1 adjacent to the arc-shaped groove 11.

There are two sealing rings 36 at the middle position 37 of the connection piece 3.

There are four liquid discharge holes 38 at the lower middle position 39 of the connection piece 3.

There is an oblique edge (or tip) 40 at the bottom of the connection piece 3.

The mouth sealing cover 2 has a dismountable structure and is connected to the aseptic bag mouth 1 through spot welding.

Figure 4:
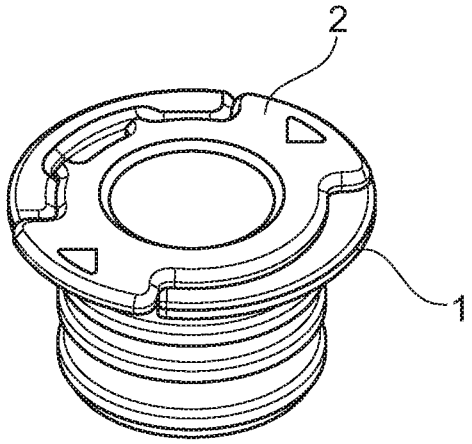
FIG. 4 is an assembly drawing of the aseptic bag mouth and the mouth sealing cover.

Assembly of bag mouth 1 and sealing cover 2 is shown in FIG. 4.

The aseptic bag mouth 1 and the mouth connection piece 3 are used as whole to realize quick and reliable connection between aseptic bag and field preparation machine.

Separate aseptic bag mouth or mouth connection piece cannot provide such function.

Figure 5:
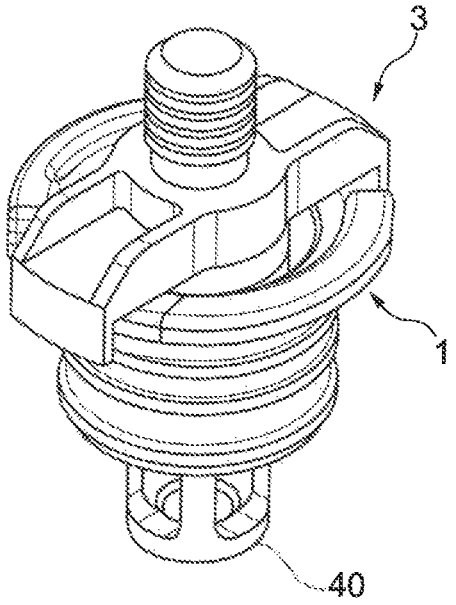
FIG. 5 is an assembly drawing of the aseptic bag mouth and the mouth connection piece at the time of inserting.
Figure 6:
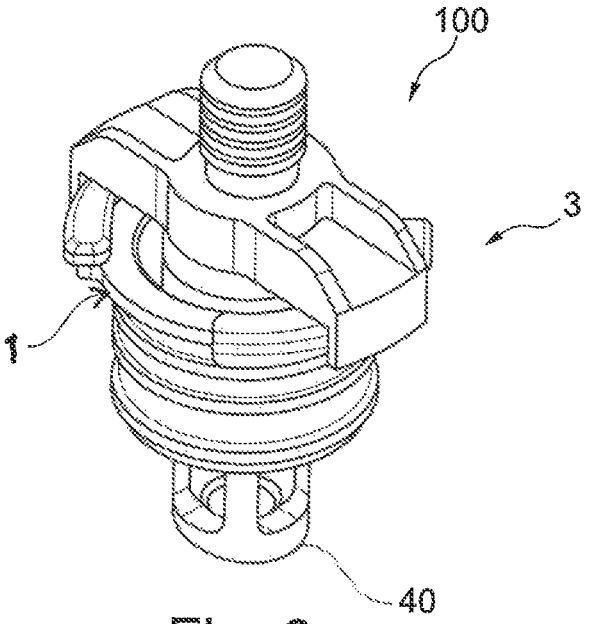
FIG. 6 is an assembly drawing of the aseptic bag mouth and the mouth connection piece at the time of using.

Assembly of aseptic bag mouth 1 and mouth connection piece 3 is shown in FIG. 5 and FIG. 6.

At the time of using, firstly take the mouth sealing cover 2 off of the aseptic bag mouth 1 and then insert the lower part of the mouth connection piece 3 into holes in the middle of the aseptic bag mouth 1 till complete contact between the rotating arm 34 on the mouth connection piece 3 and the upper surface 12 of the aseptic bag mouth 1 (as shown in FIG. 5).

When inserting, the oblique edge (or tip) 40 at the bottom of the connection piece 3 can pierce the laminate compound film at the bottom of the bag mouth 1 to realize interconnection between the inside space of the bag and the outer space.

Pay attention to the correct inserting position of the connection piece and ensure the rotating arm 34 can completely fall into the arc-shaped grooves 11 in the upper surface of the bag mouth after inserting (as shown in FIG. 5).

After full and correct inserting of the mouth connection piece 3, rotate the mouth connection piece 3 by 90 degrees through the rotating arm 34. At this moment, the slots 35 on the two sides of the rotating arm 34 contact firmly with the protruding outer edges of the upper part of the aseptic bag mouth 1 to form reliable mechanical connection between the mouth connection piece 3 and the aseptic bag mouth 1 (as shown in FIG. 6).

Meanwhile, the protruding sealing rings 36 at the bottom of the mouth connection piece 3 can realize reliable sealing between the mouth connection piece 3 and the holes in the aseptic bag mouth 1 to prevent leakage of the liquid in the bag through the gaps between the aseptic bag mouth 1 and the mouth connection piece 3.

It should be noted that the upper connector 31 of the connection piece 3 should be connected with the liquid discharge tube of field preparation machine before performing aforesaid connection, and the aseptic bag should be upside down (the upper surface of the bag mouth kept downward) during the operation.

Thus, after connection of the bag mouth 1 with the connection piece 3, the liquid in the aseptic bag can flow into the discharge tube of the field preparation machine through the four discharge holes 38 arranged in different directions at the lower position of the connection piece. At this moment, the user may start up the field preparation machine to perform automatic liquid discharging.

This aseptic bag quick connection device 100 helps to realize automatic liquid discharge of aseptic bags connected with field preparation machine, which cannot be achieved using existing technology.

With this aseptic bag quick connection device 100, the application field of aseptic bags can be broadened.

The above description is related to an embodiment only.

It should be pointed out that common technicians in this technical field may make some minor improvement and change within the principle of this invention, and such improvement and change should also be deemed protected by this disclosure.

The invention claimed is:

1. A quick connection device for an aseptic bag, said quick connection device comprising a mouth, a mouth sealing cover, and a mouth connection piece, said mouth sealing cover and said mouth connection piece being selectively mountable at the mouth, said mouth has arc-shaped grooves on an upper surface, and a lower surface of the mouth is sealed with laminate compound film, said mouth sealing cover has arc-shaped heaves on two sides, and said arc-shaped heaves are fastened with the arc-shaped grooves on the upper surface of the mouth for sealing, and said mouth connection piece is a hollow tube piece and comprises four liquid discharge holes at a lower middle position of the mouth connection piece, and an oblique edge at a bottom of the mouth connection piece, an upper and middle part of the mouth connection piece have a rotating arm, each end of said rotating arm having a slot, one dimension of the slot being consistent with one dimension of an outer edge of the mouth adjacent to the arc-shaped grooves.

2. The quick connection device of claim 1, wherein said mouth is fixed with the mouth sealing cover through spot welding.

3. The quick connection device of claim 1, wherein said upper part of the mouth connection piece is a connection for connection with a silica gel tube.

4. The quick connection device of claim 1, wherein said mouth connection piece comprises two sealing rings at a middle position of the mouth connection piece.

5. A quick connection device for an aseptic bag, the quick connection device comprising:

a mouth;

a mouth sealing cover; and a mouth connection piece;

wherein to prevent flow through the mouth, the mouth sealing cover is mountable at the mouth, wherein to allow the flow through the mouth, the mouth connection piece is mountable at the mouth, wherein the mouth comprises arc-shaped grooves on an upper surface of the mouth, wherein when the mouth sealing cover is mounted at the mouth, a lower surface of the mouth is sealed with laminate compound film, wherein the mouth sealing cover comprises arc-shaped heaves on two sides, and wherein when the mouth sealing cover is mounted at the mouth, the arc-shaped heaves are fastened with the arc-shaped grooves on the upper surface of the mouth for sealing.

6. The quick connection device of claim 5, wherein the mouth is fixed with the mouth sealing cover through spot welding.

7. The quick connection device of claim 5, wherein an upper part of the mouth connection piece is configured to connect with a silica gel tube.

8. The quick connection device of claim 5, wherein the mouth connection piece comprises sealing rings at a middle position of the mouth connection piece.

9. The quick connection device of claim 5, wherein the mouth connection piece comprises an oblique edge at a bottom of the mouth connection piece, and wherein when the mouth connection piece is mounted at the mouth, the oblique edge is configured to pierce the laminate compound film.

10. The quick connection device of claim 5, wherein the mouth connection piece comprises a hollow tube, and wherein the mouth connection piece further comprises flow holes at a lower middle position of the mouth connection piece.

11. The quick connection device of claim 5, wherein upper and middle parts of the mouth connection piece comprise a rotating arm, wherein both ends of the rotating arm comprise a slot, and wherein one dimension of both slots is consistent with one dimension of an outer edge of the mouth adjacent to the arc-shaped grooves.

12. The quick connection device of claim 5, wherein the mouth connection piece comprises a hollow tube, wherein the mouth connection piece further comprises flow holes at a lower middle position of the mouth connection piece, wherein upper and middle parts of the mouth connection piece comprise a rotating arm, wherein both ends of the rotating arm comprise a slot, and wherein one dimension of both slots is consistent with one dimension of an outer edge of the mouth adjacent to the arc-shaped grooves.

13. A quick connection device for an aseptic bag, the quick connection device comprising:

a mouth;

a mouth sealing cover; and a mouth connection piece;

wherein to prevent flow through the mouth, the mouth sealing cover is mountable at the mouth, wherein to allow the flow through the mouth, the mouth connection piece is mountable at the mouth, wherein the mouth comprises arc-shaped grooves on an upper surface of the mouth, wherein the mouth connection piece comprises a hollow tube, wherein the mouth connection piece further comprises flow holes at a lower middle position of the mouth connection piece, wherein the mouth connection piece further comprises an oblique edge at a bottom of the mouth connection piece, wherein upper and middle parts of the mouth connection piece comprise a rotating arm, wherein both ends of the rotating arm comprise a slot, and wherein one dimension of both slots is consistent with one dimension of an outer edge of the mouth adjacent to the arc-shaped grooves.

14. The quick connection device of claim 13, wherein the mouth is fixed with the mouth sealing cover through spot welding.

15. The quick connection device of claim 13, wherein the upper part of the mouth connection piece is configured to connect with a silica gel tube.

16. The quick connection device of claim 13, wherein the mouth connection piece comprises sealing rings at a middle position of the mouth connection piece.

17. The quick connection device of claim 13, wherein when the mouth connection piece is mounted at the mouth, the oblique edge is configured to pierce the laminate compound film.

18. The quick connection device of claim 13, wherein when the mouth sealing cover is mounted at the mouth, a lower surface of the mouth is sealed with laminate compound film.

19. The quick connection device of claim 13, wherein the mouth sealing cover comprises arc-shaped heaves on two sides.

20. The quick connection device of claim 19, wherein when the mouth sealing cover is mounted at the mouth, the arc-shaped heaves are fastened with the arc-shaped grooves on the upper surface of the mouth for sealing.

* * * * *